US009068333B2

(12) United States Patent
Sneve et al.

(10) Patent No.: US 9,068,333 B2
(45) Date of Patent: Jun. 30, 2015

(54) CONNECTION AND SUPPORT STRUCTURE FOR WALL MOUNTED SANITARY DEVICES SUCH AS TOILETS ETC

(75) Inventors: Audun Sneve, Levanger (NO); Jørgen Solstad, Oslo (NO); Olav Hofseth, Ulsteinvik (NO)

(73) Assignee: JETS Invest AS, Hareid (NO)

( * ) Notice: Subject to any disclaimer, the term of this patent is extended or adjusted under 35 U.S.C. 154(b) by 680 days.

(21) Appl. No.: 13/376,426

(22) PCT Filed: Jun. 7, 2010

(86) PCT No.: PCT/NO2010/000209

§ 371 (c)(1),
(2), (4) Date: Feb. 3, 2012

(87) PCT Pub. No.: WO2010/143965

PCT Pub. Date: Dec. 16, 2010

(65) Prior Publication Data

US 2012/0186008 A1 Jul. 26, 2012

(30) Foreign Application Priority Data

Jun. 8, 2009 (NO) ..... 20092207

(51) Int. Cl.
*E03D 11/14* (2006.01)

(52) U.S. Cl.
CPC ..... *E03D 11/14* (2013.01)

(58) Field of Classification Search
CPC ..... E03D 11/14; E03D 11/143; E03D 1/012
USPC ..... 4/252.2, 643, 647, 648, 649
See application file for complete search history.

(56) References Cited

U.S. PATENT DOCUMENTS 784,962 A * 3/1905 Reed ..... 4/647
846,022 A * 3/1907 Ficener ..... 4/647

(Continued)

FOREIGN PATENT DOCUMENTS

DE 29605731 U1 5/1996
JP 2005-325658 A 11/2005
NO 1005768 C1 10/1998

OTHER PUBLICATIONS

International Search Report from counterpart PCT Application No. PCT/NO2010/000209 mailed on Sep. 6, 2010 (2 pages).

(Continued)

*Primary Examiner* — Janie Christiansen
(74) *Attorney, Agent, or Firm* — Wood, Herron & Evans, LLP

(57) ABSTRACT

A connection and support structure for sanitary devices (1), such as toilet bowls (toilets 2), bidets, urinals and sinks of the kind mounted to a support or a wall in a restroom or the like. The external surface of the sanitary device (2) is smooth and has a basically continuous convex curvature without any flanges, holes or outer protrusions or connecting means. A gasket or sealing ring (14) is provided around the edge of the sanitary device (2) facing towards the support or wall onto which the device is mounted, whereby the connecting means (4, 7) including the bolts etc. (21,22) are provided within the inner space of the device (1) such that said connecting means (4,7) and bolts etc. (21,22) are sealed off from the surroundings and no moisture can enter into the inner space of the sanitary device when the sanitary device is mounted to the wall.

4 Claims, 4 Drawing Sheets

(56) References Cited

U.S. PATENT DOCUMENTS

| | | | | |
|---|---|---|---|---|
| 2,071,337 | A * | 2/1937 | Groeniger | 4/236 |
| 3,124,808 | A | 3/1964 | Tiller | |
| 5,150,480 | A * | 9/1992 | Schmucki | 4/252.3 |
| 5,909,968 | A * | 6/1999 | Olin et al. | 4/431 |
| 6,643,851 | B1 | 11/2003 | Janes | |

OTHER PUBLICATIONS

International Preliminary Report on Patentability from counterpart PCT Application No. PCT/NO2010/000209 issued on Dec. 12, 2011 (6 pages).

* cited by examiner

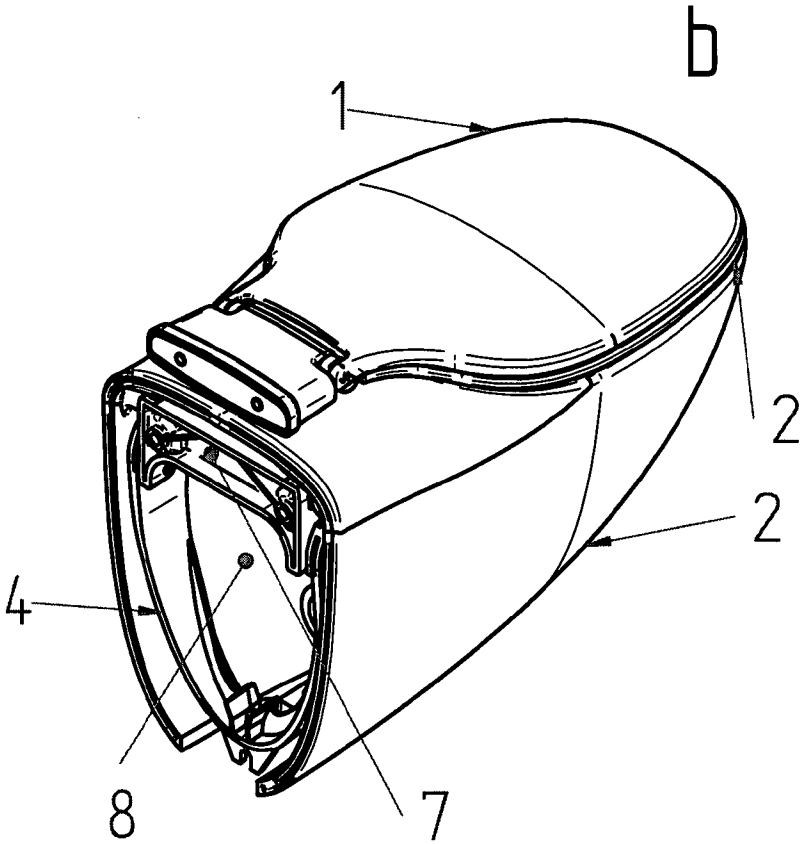
fig.1
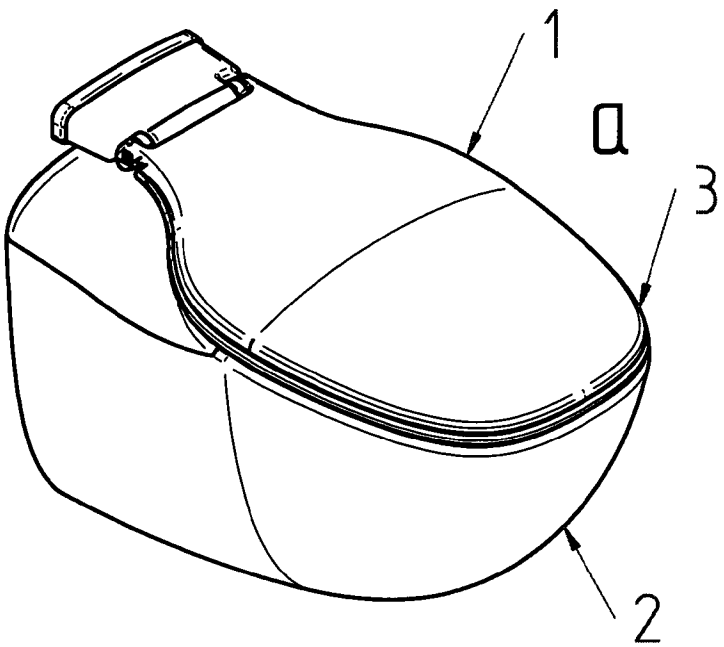

CONNECTION AND SUPPORT STRUCTURE FOR WALL MOUNTED SANITARY DEVICES SUCH AS TOILETS ETC

TECHNICAL FIELD

The present invention relates to a connection and support structure for sanitary devices, such as toilet bowls (water closets), bidets, urinals and sinks, the kind mounted to a wall in a restroom or the like.

BACKGROUND

Ordinary gravitation sewage systems for black and grey water where the toilet is emptied on the basis of flushing with relatively large amounts of water or where the water flows freely from urinals, sinks or bidets etc. with the gravitational force as the driving "power", is the most common used and known sewage system even though such systems require extensive use of water.

Vacuum sewage systems are also quite known and are dominating in connection with the use onboard ships, airplanes and trains. However, on land such systems are also increasingly used and the background for such increased use is primarily the reduced use of water and easy handling and treatment of waste water, as well as the flexible system as regards installation of the pipes given by such system.

The present invention relates to sanitary devices for both gravitational as well as vacuum sewage systems.

As of today there are different types of sanitary devices, the ones which are standing on the floor and others which, as stated above, are attached to and hanging on a wall of a restroom or the like. The present invention relates to the wall mounted type of sanitary equipment.

At present, several systems are known in order to install, hanging on the wall, the above type of sanitary devices, which generally implies the presence of a support structure which is installed inside the wall and to which the sanitary devices are fastened.

The known support structures from the prior art are mostly composed of a large number of components, and this is a first drawback because it obliges the installer to assemble, from time to time, the several elements, with an evident time waste and inconvenience.

Secondly, with the known solutions of the prior art, the installer is obliged to install feed and discharge piping inside the frame construction of the support provided in the wall without any precise references and this may, for some complicated structural solutions with little space, cause considerable difficulties and further time loss with the consequent increase in installation costs.

Thirdly, the known methods and means to fasten the sanitary device to a wall is done by using bolts or screws in through going holes in the porcelain and open holes in the wall to access the support. These solutions represent a problem with regard to moisture, cleanliness and sanitation.

From NL patent application No. 1005768, EP patent application No. 0 558 127, U.S. Pat. Nos. 6,101,766 and 6,643,851 are known different wall mounted toilets with support solutions where all of the solutions have connecting means in the form of nuts bolts or the like with through going holes in the porcelain or sanitary device which are encumbered with the above disadvantages.

SUMMARY OF THE INVENTION

With the present invention is provided a connection and support structure for connecting a sanitary device to a wall where the above disadvantages are overcome. The external surface of the sanitary device is smooth and has convex curvature where the connecting means are covered by the device as such. Thus there are no protruding connecting means such as bolts or screws that makes the sanitary device difficult to clean or that can hide harmful or smelly micro organisms. Further, the sanitary device is sealed against the wall such that water cannot enter into the wall even if the sanitary device is washed and rinsed by means of free flowing or pressurized water from a hose or shower.

BRIEF DESCRIPTION OF THE DRAWINGS

The invention will be further described in the following by way of examples and with reference to the drawings where:

FIG. 1 shows a sanitary device according to the invention in the form of a wall mounted toilet, seen in perspective, one view a) partly from ahead, and another view b) partly from behind.

DETAILED DESCRIPTION

FIG. 1 show as stated above a sanitary device 1 according to the invention in the form of a wall mounted toilet 2, 3, 4, seen in perspective, one view a) partly from ahead, and another view b) partly from behind.

Figure 2:
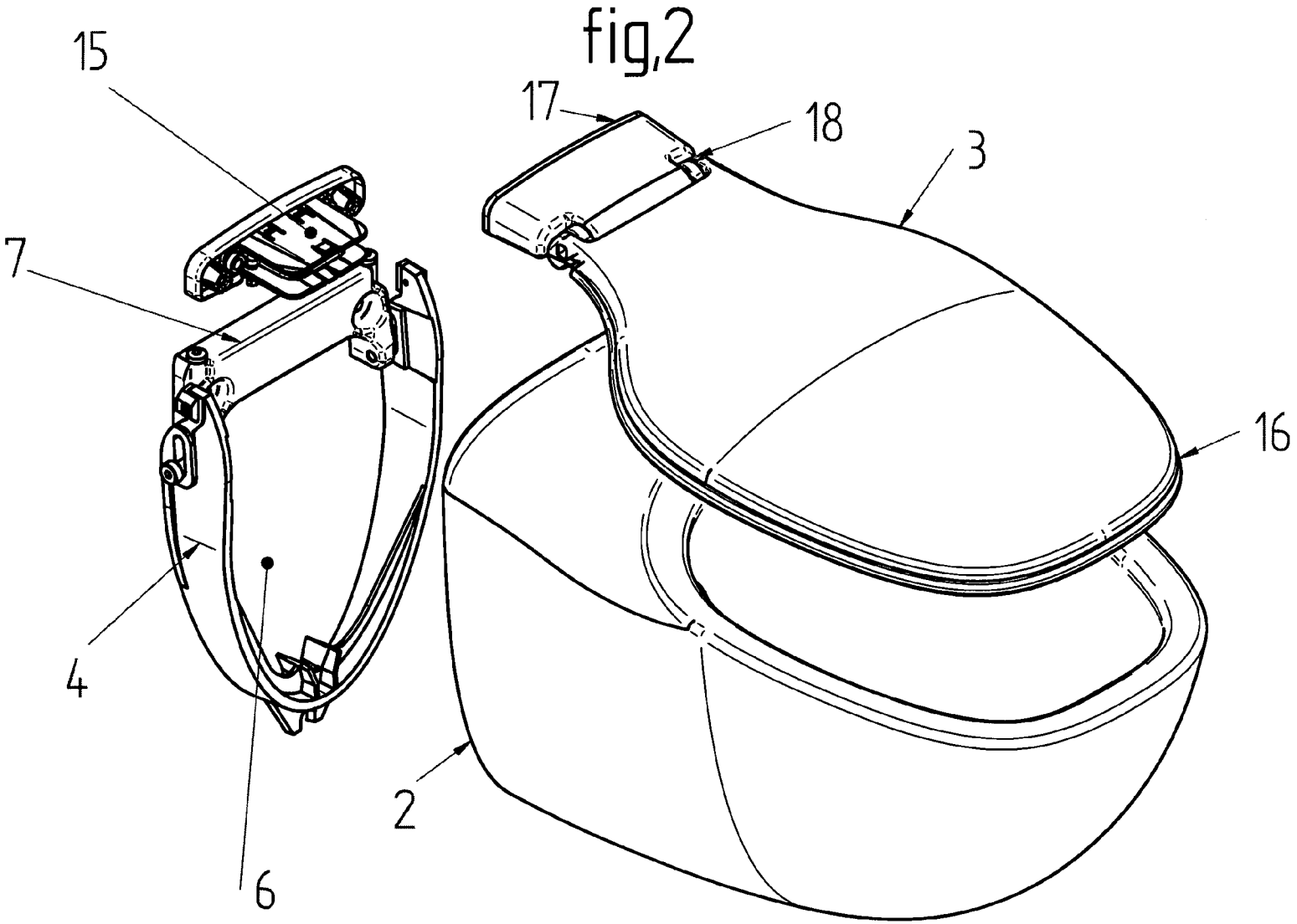
FIG. 2 shows in perspective the same toilet as in FIG. 1, but in an expanded view where the support, the toilet and toilet ring and lid are taken apart.
Figure 3:
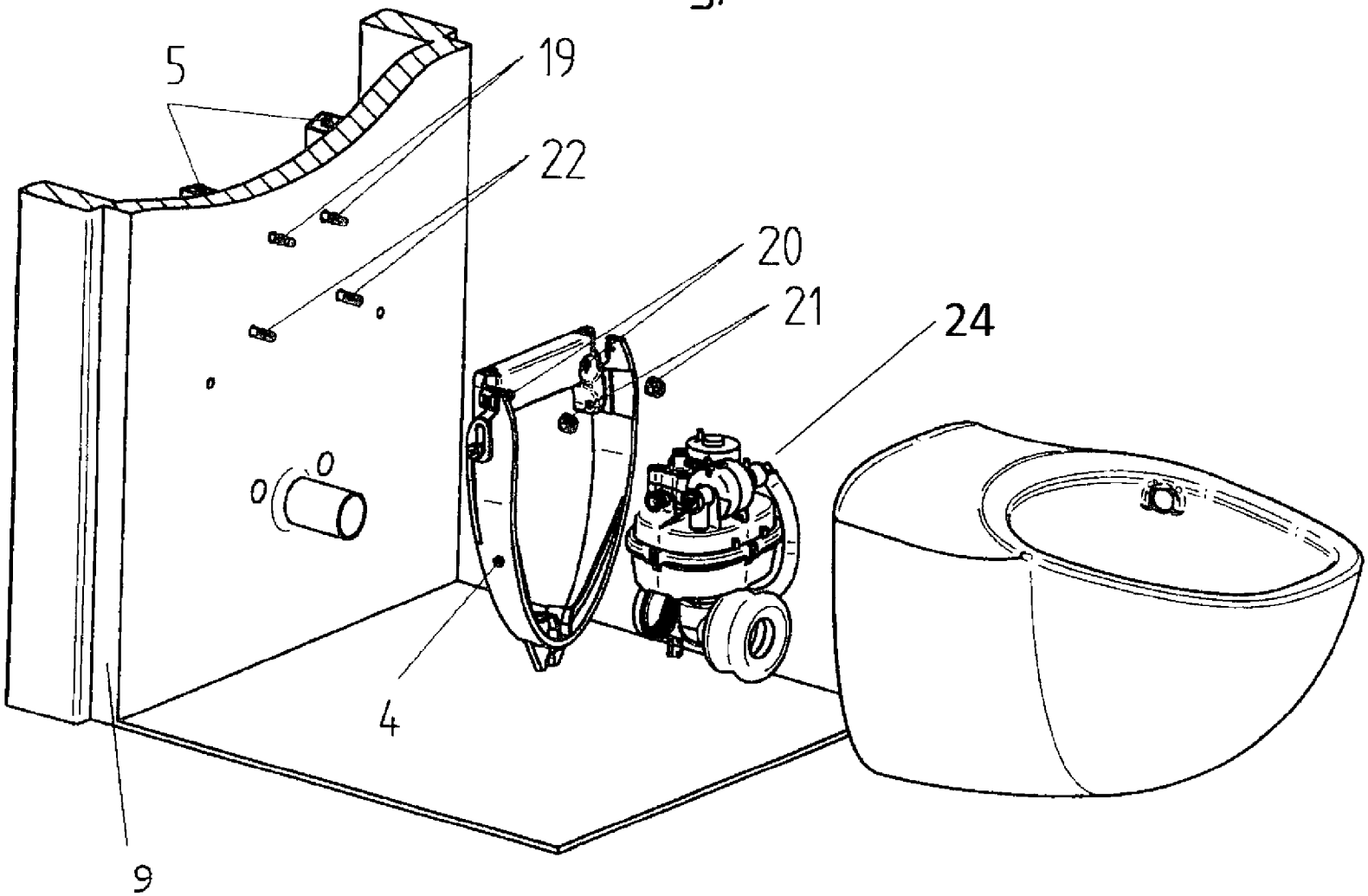
FIG. 3 shows a further expanded view of the toilet shown in the previous figures, but which also includes a discharge valve and fastening means to the wall structure.
Figure 4:
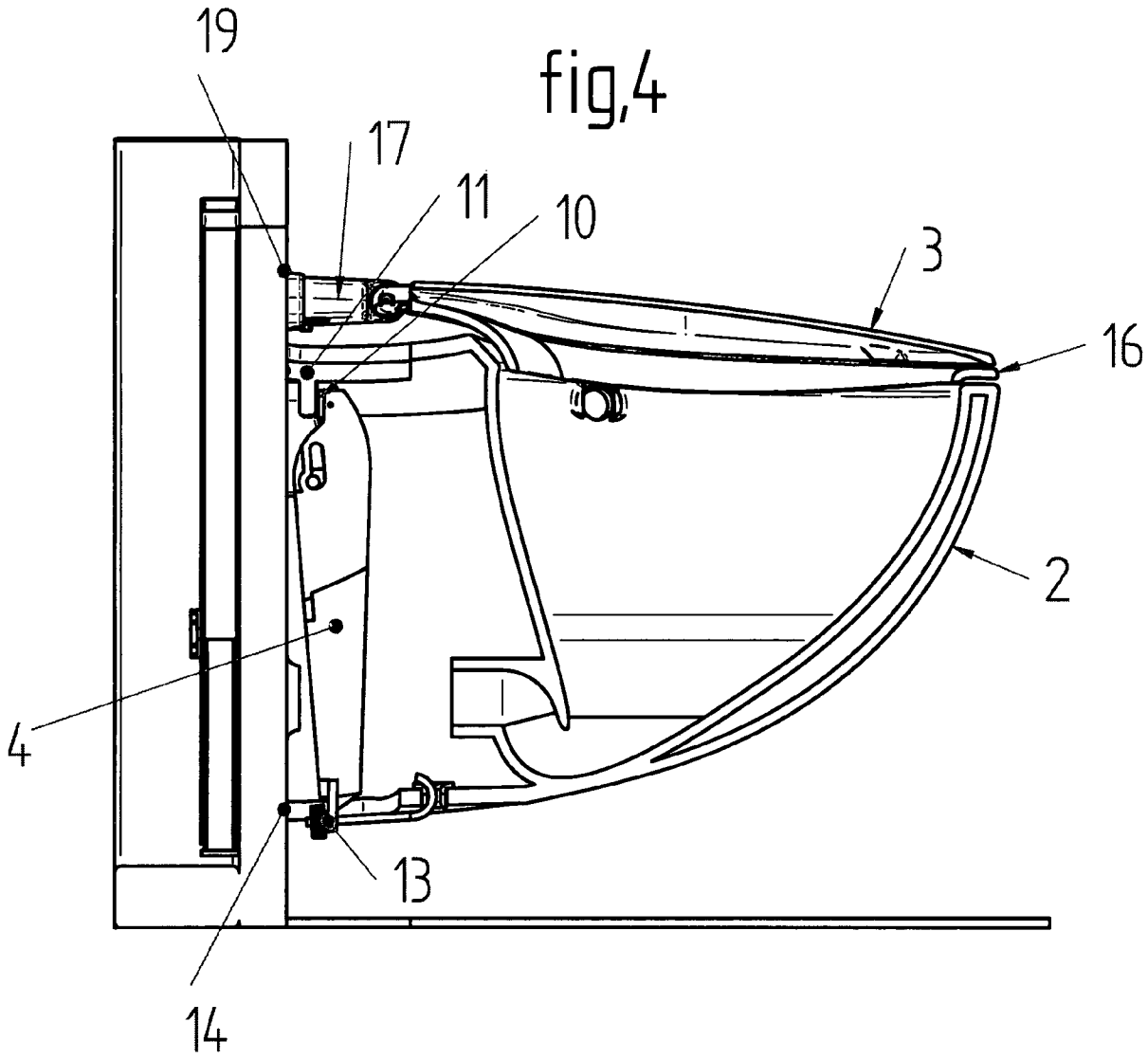
FIG. 4 shows still the same toilet in cross section mounted to the wall.

The sanitary device includes, as is further shown in FIGS. 2-4, apart from the toilet 2 a lid 3 with seat (ring) 16 and connecting means in the form of a support device 4 for fastening the sanitary device 1 to the wall.

The external surface of the toilet 2 is smooth and has a basically continuous convex curvature without any flanges, holes or outer protrusions or connecting means. (The internal surface of the toilet bowl as such is of course concave).

The support device 4 is based on an outwardly protruding flange guide 7 with a hole 6 in the centre for sewage piping etc. (not shown) to the toilet. Referring to FIGS. 3 and 4, the support device 4 may be attached to a wall in different ways, for instance by means of bolts 22 nuts 21 through holes 20 in the support 4. The bolts 22 may in turn be fastened to load carrying posts 5 or wall elements 9 (not further shown).

For completeness sake, the sanitary device shown in the figures is a toilet for a vacuum sewage system including a sewage discharge valve 24 (see FIG. 3).

The outwardly protruding flange guide 7 of the support device 4 may be basically round or oval and is designed to fit within the back end opening 8 and inner space of the toilet 2. The purpose of the flange guide 7 is to make the mounting of the toilet somewhat easier. The guide 7 is at its upper side provided with upwardly extending protrusions 10 which are designed to interact with a corresponding downwardly extending edge or protrusion 11 provided on the inside of the porcelain of the toilet 2. Thus, when the toilet is attached to the wall, the toilet 2 is just moved with its end opening 8 towards the pre-mounted guide 7 of the support 4 until the toilet meets the wall, the toilet is then lowered and the edge on the inside of the toilet will hook onto and rest on the protrusions 10 on the support 4. The toilet is then secured in this position by means of a locking arrangement 13 on the underside of the toilet 2 (not further shown). A gasket or sealing ring 14 (see FIG. 4) is provided around the edge of the toilet facing towards the support device (wall) whereby the inner space of toilet 2 and wall, including the guide means 7 and bolts etc. is sealed off from the surroundings and no moisture can enter into the wall or inner space of the toilet.

The sanitary device 1 is, as shown in FIG. 2 and FIG. 4 provided with a connecting means 15, 17 for connection of the lid 3 and toilet seat 16 to the wall. The connecting means may be a bayonet connection with a male member 15 fastened to the wall by means of bolts 19 and female connecting member 17 or a hook type connecting means with a hinge 18 between the lid/ring 3, 16 and connecting means 15, 17. A sealing element (not shown) may preferably as well be provided between the male 15 and female 17 parts of the connection to avoid moisture entering into the connection.

The invention as defined in the claims is not restricted to the examples as shown in the figures and as described above. Thus, the invention may be used for connecting any sanitary device to a wall such as a bidet, urinal or a sink. Further, the support device may, instead of being oval, have a shape corresponding to the shape of the side of the sanitary device facing the wall where the sanitary device fully covers the plate.

The invention claimed is:

1. A sanitary device for mounting to a wall in a restroom comprising;

a toilet having an external surface, an edge configured to face toward the wall, and an inner space, the external surface being generally smooth such that the external surface has a generally continuous and convex curvature without any flanges, holes, and outer protrusions;

a gasket or sealing ring provided around the edge of the toilet and configured to face toward the wall; and a support device configured to receive a bolt or a screw for attaching the toilet to a wall bearing post or a load carrying element of the wall, the support device provided within the inner space of the toilet such that the support device is fluidly sealed from a surroundings and no moisture can enter into the inner space when the toilet is mounted to the wall, wherein the support device has a guide with a hole extending through a center thereof configured to receive piping for accessing the inner space of the toilet.

2. The sanitary device of claim 1, wherein the toilet includes an opening and the support device is generally round or generally oval and configured to correspond to the opening and fit within the inner space of the toilet.

3. The sanitary device of claim 1, wherein the connection between the toilet and the support device is provided with at least one upwardly extending protrusion which is configured to interact with a corresponding downwardly extending edge or protrusion provided on an inside of the toilet, whereby the toilet is attached to the wall by the edge or protrusion on the inside of the toilet hooking onto and resting on the protrusions on the support device and whereby the toilet is secured in such position by a lock arrangement on an underside of the toilet.

4. The sanitary device of claim 1, wherein the toilet is provided with a hook type connector configured to connect a lid and toilet seat to the wall, and the hook type connector includes a hinge for hingedly connecting the lid and toilet seat.

* * * * *